US005232660A

United States Patent [19]

Finkl et al.

[11] Patent Number: 5,232,660

[45] Date of Patent: Aug. 3, 1993

[54] NITROGEN STEEL AND METHOD OF MANUFACTURE THEREOF

[75] Inventors: Charles W. Finkl, Evanston, Ill.; Albert L. Lehman, Boca Raton, Fla.

[73] Assignee: A. Finkl & Sons Co., Chicago, Ill.

[21] Appl. No.: 941,452

[22] Filed: Sep. 8, 1992

[51] Int. Cl.[5] ..... C22C 38/50

[52] U.S. Cl. ..... 420/84

[58] Field of Search ..... 420/84, 109, 128, 129, 420/115; 75/512

[56] References Cited

U.S. PATENT DOCUMENTS 5,059,389 10/1991 Finkl et al. ..... 420/109

FOREIGN PATENT DOCUMENTS 3009491 9/1980 Fed. Rep. of Germany ..... 420/84

57-131350 8/1982 Japan ..... 420/109

*Primary Examiner*—Deborah Yee

*Attorney, Agent, or Firm*—James G. Staples

[57] ABSTRACT

A low alloy steel having a medium carbon content, and less than about 5% and less than about 1% Mn, which has hardenability approaching unity derived from the presence of N in an amount of from about 100–400 ppm, and a method of manufacturing such a steel which preferably contains the processing step in the late stages of manufacture of bubbling nitrogen gas through the molten steel.

8 Claims, No Drawings

NITROGEN STEEL AND METHOD OF MANUFACTURE THEREOF

This invention pertains generally to hot work steel compositions and products, and specifically to a hot work steel composition and product which includes substantial amounts of nitrogen and consequently has increased toughness, improved hardenability, fine grain, and increased working performance as contrasted to current steels which do not include such amounts of nitrogen devoted to similar end applications. The invention further pertains to such a steel in which the above described properties will tend to be retained even when the end product is subjected to welding temperatures.

BACKGROUND OF THE INVENTION

For ease of understanding the invention will be described in terms of a primary intended application, namely hot work steels and, for further convenience, closed die drop forging. In drop forging a die is formed having a cavity which contains the desired shape of the part to be formed in negative. A metal blank from which a finished part will be fabricated is heated to a plastic condition before the blank is placed in the cavity. The upper and lower dies which form the die set are operated by powerful hammers which plastically deform the heated metal blank into a finished part which conforms to the shape of the die cavity. To be economically feasible, a die must be capable of forging thousands of parts before the die needs to be resunk.

From the foregoing description it will be appreciated that the steel from which closed die drop forging die sets are made is subjected to extremely rugged operating conditions. The die steel must be sufficiently hard so that wear of the dies, that is, expansion of the die cavity to a degree that the cavity goes oversize and produces an out of specification final product, is minimized. At the same time the die steel should have a uniform hardness throughout its depth so that the production obtained from the first and succeeding resinkings is substantially equal to the production obtained from the initial sinking. Stated another way, the die should have good through hardenability, that is, a constant or near constant hardness at all depths beneath the surface. This is in contrast to some steels in which the center portions, of large blocks particularly, tend to have a lower hardness than those portions near the surface. As those skilled in the art appreciate the property of having a uniform hardness from the surface to the center of a piece is generally referred to in the trade as hardenability, not to be confused with hardness.

In order to remain competitive with increased competition from alternative methods of forming parts, today's die block maker must offer die blocks that provide lengthened life. For example, a standard high quality die block having a nominal composition of C-.55, Mn-.85, Ni-.95, Cr-1.00, Mo-.38 and V-.05 has produced 50,000-60,000 parts on such products as pliers or other hand tools on the first and succeeding sinkings of the cavity. However, from the point of view of a manufacturer of hot work implements, there is still room for improvement over steels currently used because dies lasting 50,000-60,000 forgings between sinkings may not be competitive with casting methods, or may not be economical enough on a per piece basis to inhibit manufacturers from designing around or away from forged parts.

It has been discovered that the use of nitrogen as an alloy for low alloy die steels when present in controlled amounts, and in balance with certain other elements which affect the final N content of the steel, particularly manganese, improves both hardenability and wear resistance.

Nitrogen has previously been used as an alloy in stainless steels and high chromium steels. Furthermore, it is known that nitrogen is quite soluble in steels containing high amounts of chromium. Nitrogen has also been used in the past when conventional alloys have been unobtainable as hardening agents in special applications. However, it is believed that nitrogen has not previously been used as an alloy, and particularly as a contributor to hardenability, in low alloy steels.

The primary reason why nitrogen has not been used as an alloying element in low alloy steels is the low solubility of nitrogen in low alloy steels. Specifically, the solubility of nitrogen depends on the steel chemistry. As noted above, nitrogen is soluble in high chromium type steels and is also soluble in high manganese containing steels, but low alloy steels generally contain less than about 5% Cr and less than about 1% Mn.

In the present invention, nitrogen is held in solution in low alloy steels using titanium and aluminum in amounts sufficient to form titanium carbo-nitride and aluminum nitride without concurrent formation of titanium oxides and aluminum oxides, commonly known as dirt. The net result is low alloy steel with a substantial nitrogen content that is characterized by high hardenability, excellent hardness and good wear resistance.

SUMMARY OF THE INVENTION

The present invention is a low alloy steel especially useful in the fabrication of hot work implements such as die blocks, dies, and other equipment for forging and other hot forming operations, and a method of manufacturing such steels. The steel is characterized by the presence of a substantial amount of nitrogen which improves the hardness, hardenability, and wear resistant properties of the steel. The nitrogen, in amounts ranging from 100 to 400 parts per million has been added to low alloy steels having the following compositions in approximate weight percent: C—from about 0.38 to about 0.52; phosphorous—0.02 max; sulfur—0.02 max; manganese—from about 0.70 to about 1.00; silicon—from about 0.20 to about 0.45; nickel—from about 0.60 to about 1.00; chromium—from about 1.75 to about 2.15; molybdenum—from about 0.40 to about 0.60; and vanadium—from about 0.03 to about 0.10.

Other alloy elements that contribute to the desirable characteristics of the steel, when present, include calcium in an amount from about 0.003 to about 0.006. Titanium and aluminum also assist in increasing the solubility of nitrogen. Nitrogen and aluminum react to form aluminum nitride which is a wear resisting material. Titanium, carbon and nitrogen react to form titanium carbo-nitride, another wear resisting material.

It is therefore an object of the present invention to provide a low alloy steel having the following board composition:

| | | |
|---|---|---|
| C | from about | 0.38-0.52 |
| P | | 0.020 max |
| S | | 0.020 max |
| Mn | from about | 0.70-1.00 |
| Si | " | 0.20-0.45 |
| Ni | " | 0.60-1.00 |

-continued

| | | |
|---|---|---|
| Cr | " | 1.75–2.15 |
| Mo | " | 0.40–0.65 |
| V | " | 0.03–0.12 |
| N, ppm | " | 100–400 |
| Ti | " | 0.003–0.02 |
| Al | " | 0.015–0.04 |
| Ca | " | 0.003–0.006 |

More preferably, it is an object of the present invention to provide a low alloy steel having the following preferred composition:

| | | |
|---|---|---|
| C | from about | 0.4–0.5 |
| P | | 0.02 max |
| S | | 0.02 max |
| Mn | from about | 0.75–0.95 |
| Si | " | 0.25–0.45 |
| Ni | " | 0.70–0.90 |
| Cr | " | 1.90–2.10 |
| Mo | " | 0.45–0.55 |
| V | " | about 0.08 |
| N, ppm | " | 100–300 |
| Ti | " | 0.003–0.0075 |
| Al | " | 0.015–0.030 |
| Ca | " | 0.002–0.004 |

Yet another object of the present invention is to provide a die block having the following aim composition:

| | | Aim |
|---|---|---|
| C | about | 0.45 |
| P | " | 0.020 max |
| S | " | 0.020 max |
| Mn | " | 0.85 |
| Si | " | 0.35 |
| Ni | " | 0.80 |
| Cr | " | 2.00 |
| Mo | " | 0.50 |
| V | " | 0.08 |
| N, ppm | " | 200 |
| Ti | " | 0.015 |
| Al | " | 0.020 |
| Ca | " | 0.003 |

In all cases AL is preferably present in an amount about 7 times Ca.

DETAILED DESCRIPTION OF THE INVENTION

The board, intermediate and preferred compositional ranges of the new and improved nitrogen containing low alloy steels of this invention are as follows:

| Elements | Broad | Intermediate | Preferred |
|---|---|---|---|
| C | 0.38–0.52 | 0.4–0.5 | about 0.45 |
| P | 0.02 max | 0.02 max | 0.02 max |
| S | 0.02 max | 0.02 max | 0.02 max |
| Mn | 0.70–1.00 | 0.75–0.95 | about 0.85 |
| Si | 0.20–0.45 | 0.25–0.45 | about 0.35 |
| Ni | 0.60–1.00 | 0.70–0.90 | about 0.80 |
| Cr | 1.75–2.15 | 1.90–2.10 | about 2.00 |
| Mo | 0.40–0.60 | 0.45–0.55 | about 0.50 |
| V | 0.03–0.10 | about 0.08 | about 0.08 |
| $N_2$ | 100–400 ppm | 100–300 ppm | about 200 ppm |
| Ti | 0.003–0.020 | 0.003–0.0075 | about 0.015 |
| Al | 0.015–0.040 | 0.015–0.030 | about 0.020 |
| Ca | 0.003–0.006 | 0.002–0.004 | about 0.003 |

Balance: substantially all iron with the usual impurities.

Carbon is necessary to provide the required wear resistance and hardness. If the carbon content is significantly higher than about 0.52 the die blocks could, under some conditions, be subject to breakage in the field. If substantially less than about 0.38 carbon is used, the wear resistance may not be suitable for the extremely strenuous field applications to which the die blocks are subjected, even considering the increased hardness imparted to the die blocks by nitrogen. Preferably, a minimum of about 0.4 and a maximum of about 0.5 carbon is used to ensure good wear resistance, hardness and maximum production. Most preferably, carbon in an amount of about 0.45% is present.

Manganese is necessary for hardenability and as a deoxidizer in the steel making process. More importantly, it has been found that nitrogen is more soluble in steels containing manganese and, further, it is believed that nitrogen in combination with manganese, titanium and aluminum provides exceptional quality enhancement as will be discussed in greater detail hereinafter.

Manganese also functions to control sulfides in the forging operations. If significantly more than about 1.00% manganese is present, there is a danger that retained austenite will be present and the steel may become "dirty" during the melting phase of production. If substantially less than about 0.70% manganese is present, the hardenability of the die block may be detrimentally affected. In addition, manganese contributes to wear resistance, although to a lesser extent than other carbide formers, such as vanadium, molybdenum and chromium. Preferably, manganese is present in the range of from about 0.75 to about 0.95 with a most preferred amount of about 0.85. Further, manganese should be present in an amount at least about twenty times the sulfur content to ensure sulfur control; i.e., in an amount to ensure that there is no formation of Iron Sulphide which is detrimental to hot workability of the steel Phosphorous can exert a beneficial effect on machinability. However, the detrimental effects of phosphorous, such as an increase in the transition temperature, may outweigh any beneficial effects, and, accordingly, the phosphorous content should be kept as low as possible. Preferably, the phosphorous should not exceed about 0.020%. It has been observed that greatly enhanced impact values and ductility have resulted when the phosphorous content has been limited, and enhanced impact values and ductility translate into reduced die breakage.

Sulfur is a desirable element because it promotes machinability. However, excess sulfur causes the formation of sulfides which are a contaminant in this type of steel. Specifically, sulfides adversely affect the transverse properties of the finished product thereby resulting in lower than desired RATs (reduction of area, transverse). Thus, it is preferred that sulfur be limited to no more than about 0.020 percent.

Silicon is specified for its deoxidizing ability in the steel making process. If silicon is present in substantially greater quantities than about 0.50 percent, there may be a tendency towards embrittlement of the final product. If die blocks are made by conventional electric furnace steel making techniques, the silicon may be in the range from about 0.2 to about 0.45 percent. The preferred range for silicon is about 0.25 to about 0.45 with an aim of about 0.35 percent.

Nickel is required to impart toughness and hardenability to die blocks manufactured from the steel of the present invention. Further, nickel does not form any carbides; it remains in solution in the ferrite, strengthening and toughening the ferrite. If substantially more than about 1.0 percent nickel is present, there is a danger of retained austenite and decreased machinability. Excess nickel may also promote hairline cracking which requires scarfing and/or conditioning at the press. If substantially less than about 0.6 percent nickel is present, the die block may lack toughness and hardenability will be reduced. Preferably, nickel should be present in the range of from about 0.7 to about 0.9 percent with an aim of about 0.80 percent.

Chromium is necessary for carbide formation, for hardenability and for wear resistance. If substantially more than about 2.15 percent chromium is present, the hardening temperature may be too high for conventional production processes and heavy sections of the die block may be subject to loose or weak centers. If substantially less than about 1.75 percent chromium is present, the die block could be deficient in wear resistance and hardenability. Preferably, chromium is present in an amount of from about 1.9 to about 2.1 percent with an aim of about 2.00 percent.

Molybdenum is one of the most important alloy elements in that it is a potent carbide former and contributes to hardenability and wear resistance. Preferably, the molybdenum is maintained between from about 0.45 to about 0.55 since this range appears to yield optimum results, although a range of from about 0.40 to about 0.60 is acceptable. The preferred weight percent of molybdenum is about 0.50 percent. For thick sections, it may be desirable to work near the upper end of the broad range, namely about 0.55 percent or slightly higher to ensure thorough response to the hardening process. It is not advantageous to employ the minimum weight percents of molybdenum for products of substantial cross-sectional thickness. If more than about 0.60 molybdenum is present, the carbon would have to be increased which would result in a steel that is (a) not as tough and (b) more brittle than the low alloy steel of the present invention.

Vanadium is specified for its grain refining properties. If significantly more than about 0.10% vanadium is present, the hardenability of a die block may be decreased due to the insolubility of vanadium carbide at normal heat treatment temperatures. If significantly less than about 0.03 vanadium is present, the necessary grain refinement may not be achieved. Preferably, vanadium is present in an amount of about 0.08%, although a vanadium range from about 0.03 to about 0.10% is acceptable.

Aluminum is included in the preferred composition because it will react with nitrogen to form aluminum nitrides. Aluminum nitrides add wear resisting properties to the steel. Further, aluminum is desirable for grain refinement and, in low quantities, for fluidization of the molten steel since the amount of aluminum present has been considered to have a significant effect on the quantity of aluminates, and since aluminates have been universally considered to be a contaminant, it is therefore important to minimize the amount of aluminum present to limit the amount of aluminate contaminants. Further, excess aluminum can form aluminum oxides and other undesirable contaminants which are commonly referred to as "dirt".

If less than about 0.015 aluminum is present, the desired grain size effect and the aluminum nitride formation may not be achieved. If more than about 0.040% aluminum is present, the grain may coarsen to an undesirable extent. The result would also be a greater quantity of non-metallic inclusions which affect surface notch toughness. In this invention, the aluminum is present in amounts of from about 0.015 to about 0.040% with a preferred range of from about 0.015 to about 0.030%, and aim of about 0.020%.

Calcium, like nickel, does not form carbides in steel, but dissolves in and strengthens the ferrite. Calcium is known to impart high mechanical property values and substantial resistance to atmospheric corrosion in die steel applications, and in high-strength low alloy steel applications generally. However, it is important that the amount of calcium be limited with respect to the amount of aluminum present. Specifically, the amount of calcium should be about 15 percent or 1/7 of the amount of aluminum. The aluminum to calcium ratio of 7:1 ensures globularization of the carbide lamellae in the ferrite. Further, maintaining the proper aluminum to calcium ratio ensures improved machinability of the finished products. Thus, if the aluminum aim is 0.020 percent, the calcium content should be maintained at about 0.003 percent. However, calcium may be present in amounts of from about 0.003 to about 0.006 depending upon the amount of aluminum present.

Titanium is important because it will increase the solubility of the nitrogen by forming titanium carbonitride if titanium is present in the steel in amounts of up to about 0.02%. Titanium in amounts greater than about 0.02% will form titania, or titanium oxides. Titanium oxides, like aluminates and aluminum oxides, are contaminants which adversely affect steel quality. Titanium in amounts less than about 0.003% will not result in the desired increase in nitrogen solubility or formation of titanium carbo-nitride.

Until the development of the present invention nitrogen has not been significantly utilized as an alloying element in low alloy steels. During the development of the present invention it has been learned that nitrogen in combination with aluminum and titanium in steels containing manganese enhances the hardenability, hardness and wear resistance of the steels; indeed, production increases of over 50% have been achieved in die life. The nitrogen forms aluminum nitrides which are wear resisting materials. Aluminum nitrides tend to form a nucleus for fine grained steel formation.

Nitrogen also forms titanium carbo-nitrides when titanium is present in the steel. Nitrogen promotes through hardening which essentially means that a die block made in accordance with the present invention will have approximately uniform thickness from center to surface, all of which translates into a better die block. It is well recognized that the ideal steel for fabricating forging dies should have the same high reduction of area in both a transverse and longitudinal direction so that the steel, when made into a die, will be equally resistant to cracking, and equally strong, in all directions. Attainment of this goal would greatly simplify die design, since the die designer can ignore the "grain" of the steel in designing and fabricating the die, and greater die life is therefore achievable. Consequently, a primary goal achieved by the use of nitrogen as an alloy in the low alloy steels with which the present invention is concerned is to achieve a ratio of the reduction of area transverse to the reduction of area longitudinal which closely approaches 1.0.

As noted above, the preferred concentration of nitrogen is about 200 ppm. If the nitrogen concentration drops below about 100 ppm, the desired objectives of through hardness and increased wear resistance will not be met. On the other hand, nitrogen concentrations of greater than about 400 ppm would require excessive amounts of aluminum, titanium, manganese and chromium, which excessive amounts could adversely affect the quality of the steel for the reason stated herein. Further, it is believed that very high contents of N may have the effect of lowering the lower critical temperature. If the dies, in use, are subject to unusually high heat, this condition of a lower critical temperature could be of concern.

In the alloying limits of the low alloy and lower alloyed tool steel grades, the combination of titanium aluminum additions, coupled with manganese solubility of nitrogen, possibly yields the greatest quality enhancement. The titanium carbo-nitride will form with a titanium addition of up to 0.02% Ti; any additional titanium will form titania which adversely affects steel quality. The aluminum forms aluminum nitride and is essential to grain size control of the steel. The combination of both of these elements, to finely controlled limits, yields steels that do not coarsen at elevated temperatures. This is even true for the areas of steel involved with welding temperatures.

As the result of this technology, new die steels utilizing the chemistry adjustments necessary to hold nitrogen in solution in steel have been made with acceptable levels of nitrogen now available. The most advantageous stabilizers are added to the steel in exact, discrete amounts to perform only the formation of titanium carbo-nitride and aluminum nitride formation without formation of dirt; i.e.: the oxides of these elements.

The dramatic improvement in production made possible by the present invention can best be appreciated from a comparison of the production obtained from dies manufactured from the steel of this invention and the production obtained from dies manufactured from a conventional high Cr—high Mo steel which is widely used. Specifically, the composition of the two steels where as follows:

| | C | Mn | P | S | Si | Ni | Cr | Mo | V | Al | Ca ppm | Ti | N ppm |
|---|---|---|---|---|---|---|---|---|---|---|---|---|---|
| Conventional Steel | .44 | .92 | .014 | .006 | .40 | .8 | 2.65 | 1.02 | .049 | .017 | 33 | 0 | 53 |
| New Steel | .50 | .89 | .010 | .009 | .35 | .94 | 2.05 | .62 | .12 | .029 | 11 | | 222 |

Ti was added in an amount calculated to fall into the broad range herein specified but unfortunately a reading was not obtained. Ca was also added in an amount to fall into the broad range but, it is believed, was burned out in an amount greater than desired during the final stages of vacuum treatment.

Jominy test specimens of the new steel yielded the following results:

| | |
|---|---|
| J1 | 61 |
| J2 | 61 |
| J3 | 61 |
| J4 | 61 |
| J5 | 61 |
| J6 | 61 |
| J7 | 61 |
| J8 | 61 |
| J9 | 61 |
| J10 | 61 |
| J11 | 61 |
| J12 | 61 |
| J13 | 61 |
| J14 | 61 |
| J15 | 61 |

-continued

| | |
|---|---|
| J16 | 61 |
| J18 | 61 |
| J20 | 61 |
| J22 | 61 |
| J24 | 61 |
| J26 | 61 |
| J28 | 61 |
| J30 | 61 |
| J32 | 61 |

From the above results the outstanding hardenability of the new steel can be appreciated.

From long experience, production runs using due blocks comprised of the Conventional Steel yielded 70,000–75,000 pieces on conventional 6 inch pliers. By comparison, a production run using a die block insert of the above described New Steel yielded 106,000 pieces of the same conventional 6 inch pliers, a 41% to 51% production increase. The Conventional Steel and the New Steel had been tempered to the same BHN range.

The estimated cost for low alloy steels made in accordance with the present invention is approximately 10–15% higher per pound than the cost of the above described conventional Steel. However, the 10–15% increase in cost provides the user with a die block that lasts up to approximately 50% longer between sinkings than the Conventional Steel, thereby substantially reducing the cost of production on a per piece basis.

Manufacture of the steel of this invention may be advantageously carried out in the basic electric furnace, preferably in conjunction with a post-melting refiner such as a vacuum arc degassing system. An exemplary processing sequence would be as follows.

A 65–75 ton heat will be melted in a basic electric furnace. Following adjustments in the furnace to bring selected alloying constituents to minimal, or at least initial levels, the steel should be tapped into a ladle at about 2800°–3000° F. At this point in time exemplary O and H contents of about 80 ppm O and 4–5 ppm H will exist.

Thereafter make up quantities of such elements as nickel, molybdenum, vanadium, silicon, manganese, chromium, and iron pyrites may be added to the ladle, together with conventional complex oxides for inclusion shape control, such as CaSi. Following ladle additions the temperature of the heat will be about 2900° F.; exemplary gas contents may be about 60 ppm O and 4–5 ppm H.

Thereafter the heat may be subjected to a simultaneous vacuum and gas purging treatment as initially described in U.S. Pat. No. 3,236,635 and subsequent literature, preferably using nitrogen as the purging gas. Either simultaneously with or following the vacuum purging treatment the heat may be subjected to intermittent or continuous arc heating under vacuum, and nitrogen purging, said arc heating being more fully described in U.S. Pat. No. 3,501,289 and subsequent literature. The temperature at the conclusion of the arc heating process will advantageously be in the range of 2880°–2900° F. At this point in the cycle a typical O content would be approximately 30 ppm and a typical H content would be about 2 ppm or even below.

Thereafter one or more additions of aluminum and FeTi may be made to the ladle and the melt purged with $N_2$ to ensure thorough mixing of the aluminum and titanium in the steel, and, further, to enable the aluminum to react with contained N to form aluminum nitrides and titanium to combine with carbon and nitrogen to form titanium carbo-nitrides.

Following Al and Ti additions and thorough mixing, the steel may be teemed in a temperature range of from about 2840°-2860° F., preferably through an inert gas shroud or by vacuum teeming and/or splash plates or bottom pouring. If the heat is tapped through a tap hole block having a smooth surface, very little nitrogen will be picked up from the ambient atmosphere during tapping and hence the use of nitrogen for purging to the maximum extent possible is preferred.

The thus formed aluminum nitrides and the titanium carbo-nitrides will, it is believed, be held within the grain boundaries and thus act to harden and strengthen the steel, all without the formation of dirt if done in the ratios herein disclosed, as contrasted to alumina and/or titania which locates between the grains and thus opens the possibility of acting as stress raisers.

The result is a steel having increased toughness, increased die life, improved hardenability, excellent grain size (and the ability to control grain size), and properties retention at welding temperature. The manganese, particularly, chromium, and to a lesser extent vanadium, titanium and aluminum all aid in the solubility of N in the steel which results in the improved production results described above.

From the foregoing description it will be appreciated that a unique low alloy steel especially suited for fabrication of die blocks and other forging equipment having higher than previously known levels of nitrogen, together with a method of manufacturing such steels, has been disclosed. Various modifications will, of course, occur to those skilled in the art. Accordingly, the scope of the invention is intended to be limited not by the scope or the foregoing exemplary description, but only by the scope of the hereinafter appended claims when interpreted in light of the pertinent prior art.

We claim:

1. A low alloy steel having high hardenability and excellent wear resistance, said having the following approximate composition:

| | | | | |
|---|---|---|---|---|
| C | from about | .38 | to about | .52 |
| P | | | | .02 max |
| S | | | | .02 max |
| Mn | from about | .70 | to about | 1.00 |
| Si | from about | .20 | to about | .45 |
| Ni | from about | .60 | to about | 1.00 |
| Cr | from about | 1.75 | to about | 2.15 |
| Mo | from about | .40 | to about | .62 |
| V | from about | .03 | to about | .12 |
| Al | from about | .015 | to about | .040 |
| Ca | from about | .003 | to about | .006 |
| Ti | from about | .003 | to about | .020 |
| N | from about | 100 | ppm to about | 400 ppm |

balance Fe with incidental impurities.

2. The low alloy steel of claim 1 in which said steel has an ideal critical diameter of at least about 18.

3. In a method of making a low alloy steel having the composition set out in claim 1, the steps of purging with nitrogen gas during gas purging treatment.

4. In a method of making a low alloy steel having hardenability which approaches unity the steps of forming a metal of steel containing C in the range of about 0.38 to 0.52, Mn in the range of about 0.70 to 1.00, and Cr in an amount less than about 5%, adding Ti in an amount sufficient to yield a final Ti content of from about 0.003 to 0.020, adding Al in an amount sufficient to yield a final Al content of about 0.015 to about 0.040, adding N to the melt just prior to and/or just after the Ti and Al additions in an amount sufficient to yield a final N content of from about 100 ppm to about 400 ppm, the amount of Ti and Al added being sufficient in any event to form titanium nitrides and aluminum carbo-nitrides in preference to titanium oxides and aluminum oxides in the final product.

5. The method of claim 5 in which Mo is added in an amount sufficient to yield a final Mo content of from about 0.40 to about 0.60.

6. The method of claim 4 in which Ca is added in an amount sufficient to (a) yield a final Ca content of from about 0.003 to about 0.006 with (b) a Ca to Al ratio in the final product of about 1:7.

7. The low alloy steel of claim 1 having the following, approximate composition:

| | |
|---|---|
| C from about 0.4 to about | .5 |
| P | .02 max |
| S | .02 max |
| Mn from about 0.75 to about | 0.95 |
| Si from about 0.25 to about | 0.45 |
| Ni from about 0.70 to about | 0.90 |
| Cl from about 1.90 to about | 2.10 |
| Mo from about 0.45 to about | 0.55 |
| V about | 0.08 |
| N, ppm about | 100-300 |
| Ti from about 0.003 to about | 0.0075 |
| Al from about 0.015 to about | 0.030 |
| Ca from about 0.002 to about | 0.004 |

balance Fe with incidental impurities.

8. The low alloy steel of claim 7 having the following approximate composition:

| | |
|---|---|
| C about | 0.45 |
| P | 0.020 max |
| S | 0.020 max |
| Mn about | 0.85 |
| Si about | 0.35 |
| Ni about | 0.8 |
| Cr about | 2.0 |
| Mo about | 0.5 |
| V about | 0.08 |
| N, pmm about | 200 |
| Ti about | 0.015 |
| Al about | 0.020 |
| Ca about | 0.003 |

* * * * *